US006070821A

United States Patent [19]

Mitchell

[11] Patent Number: 6,070,821

[45] **Date of Patent: *Jun. 6, 2000**

[54] INDENTED CORELESS ROLLS AND METHODS OF MAKING AND USING

[75] Inventor: Joseph Mitchell, Gloucester, N.J.

[73] Assignee: Kimberly-Clark Worldwide, Neenah, Wis.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/843,670

[22] Filed: Apr. 10, 1997

Related U.S. Application Data

[63] Continuation of application No. 08/402,341, Mar. 10, 1995, Pat. No. 5,620,148.

[51] Int. Cl.[7] ..... B65H 18/28

[52] U.S. Cl. ..... 242/160.4

[58] Field of Search ..... 242/160.1, 160.4, 242/541.2, 596, 599.4; 162/718, 120, 122; 264/322, 324, 572

[56] References Cited

U.S. PATENT DOCUMENTS

| | | | |
|---|---|---|---|
| Re. 25,828 | 8/1965 | Wooster . | |
| D. 238,462 | 1/1976 | Bauman | D6/97 |
| D. 238,466 | 1/1976 | Bauman | D6/97 |
| D. 316,201 | 4/1991 | Shimasaki | D6/518 |
| D. 318,770 | 8/1991 | Grisel | D6/523 |
| D. 327,798 | 7/1992 | Addison et al. | D6/523 |
| 390,084 | 9/1888 | Lane . | |
| 419,811 | 1/1890 | Zerr . | |
| 498,900 | 6/1893 | Hicks | 242/599.4 |
| 1,217,211 | 2/1917 | Pico . | |

(List continued on next page.)

FOREIGN PATENT DOCUMENTS

| | | |
|---|---|---|
| 933971 | 2/1970 | Canada . |
| 928671 | 6/1973 | Canada . |
| 2190806 | 6/1997 | Canada . |
| 0 089 933 | 9/1983 | European Pat. Off. . |
| 0618159A2 | 2/1994 | European Pat. Off. . |

(List continued on next page.)

OTHER PUBLICATIONS

JP 8196469 A (Abstract Only); Assignee: Sekisui Chem Ind Co. Ltd.; Mar. 4, 1991.
JP 8333041 A (Abstract Only); Assignee: Taisei Tekkosho KK; Dec. 17, 1996.
JP 8333055 A (Abstract Only); Assignee: Uchinami KK; Dec. 17, 1996.
JP 9118455 A (Abstract Only); Assignee: Taisei Tekkosho KK; May 6, 1997.
JP 9216755 A (Abstrsct Only); Assignee: Yamazaki T; Aug. 19, 1997.
JP 9323849 A (Abstract Only); Assignee: Taisei Tekkosho KK; Dec. 16, 1997.
TW 293002 A (Abstract Only); Assignee: Minnesota Mining & Mfg. Co.; Dec. 11, 1996.

*Primary Examiner*—Donald P. Walsh
*Assistant Examiner*—Emmanuel M. Marcelo
*Attorney, Agent, or Firm*—Karl V. Sidor

[57] ABSTRACT

A careless roll of absorbent paper product such as toilet tissue is configured to be easier to mount to a rotary dispenser than careless rolls heretofore known. The careless roll includes a rolled web of absorbent paper product that is rolled about a winding axis into a cylinder having first and second flat ends, and a pair of depressions defined in the careless roll. A first of the depressions is defined on one side of the roll and is substantially centered with respect to a winding axis of the roll, and the second depression is on a second, opposite side of the roll and is also substantially centered with respect to the winding axis of the roll. Methods of making and using the coreless web are also described.

11 Claims, 2 Drawing Sheets

U.S. PATENT DOCUMENTS

| | | | |
|---|---|---|---|
| 1,229,431 | 6/1917 | Farrell . | |
| 1,778,282 | 10/1930 | Stewart . | |
| 2,049,964 | 8/1936 | Lawson . | |
| 2,232,968 | 2/1941 | Price et al. | 242/160.1 |
| 2,276,414 | 3/1942 | Morehouse et al. . | |
| 2,299,626 | 10/1942 | Hunt . | |
| 2,308,840 | 1/1943 | Vaughan et al. . | |
| 2,380,644 | 7/1945 | Grondona . | |
| 2,390,399 | 12/1945 | Tator et al. . | |
| 2,555,885 | 6/1951 | Hope . | |
| 2,566,883 | 9/1951 | Gove . | |
| 2,583,411 | 1/1952 | Carlin . | |
| 2,643,069 | 6/1953 | Carlin . | |
| 2,695,208 | 11/1954 | Graham . | |
| 2,726,823 | 12/1955 | Jespersen . | |
| 2,790,608 | 4/1957 | Sieven . | |
| 2,819,852 | 1/1958 | Sarro . | |
| 2,830,775 | 4/1958 | Kiesel . | |
| 2,839,346 | 6/1958 | Lawalin . | |
| 2,845,231 | 7/1958 | Grettve . | |
| 2,849,191 | 8/1958 | Gadler . | |
| 2,872,263 | 2/1959 | Andersson . | |
| 2,873,158 | 2/1959 | Pinkham, Jr. . | |
| 2,879,012 | 3/1959 | Sarro . | |
| 2,905,404 | 9/1959 | Simmons | 242/55.2 |
| 2,939,645 | 6/1960 | Rowlands et al. . | |
| 2,946,636 | 7/1960 | Penney . | |
| 3,004,693 | 10/1961 | Johnson | 225/77 |
| 3,029,035 | 4/1962 | Layton | 242/160.1 |
| 3,032,283 | 5/1962 | Wooster . | |
| 3,034,739 | 5/1962 | Barger . | |
| 3,038,598 | 6/1962 | Layton et al. | 242/160.1 |
| 3,045,939 | 7/1962 | VanderWaal . | |
| 3,084,006 | 4/1963 | Roemer . | |
| 3,333,909 | 8/1967 | Beker . | |
| 3,580,651 | 5/1971 | Gauper . | |
| 3,729,145 | 4/1973 | Koo et al. . | |
| 3,791,601 | 2/1974 | Broden . | |
| 3,794,253 | 2/1974 | Megdall . | |
| 3,799,467 | 3/1974 | Bauman . | |
| 3,802,639 | 4/1974 | Dowd, Jr. . | |
| 3,823,887 | 7/1974 | Gerstein . | |
| 3,826,361 | 7/1974 | Heckrodt | 206/409 |
| 3,830,143 | 8/1974 | Dowd, Jr. | 23/84 FF |
| 3,853,279 | 12/1974 | Gerstein . | |
| 3,856,226 | 12/1974 | Dowd, Jr. . | |
| 3,878,998 | 4/1975 | Lazzari . | |
| 4,013,236 | 3/1977 | Perrin . | |
| 4,013,240 | 3/1977 | Perria . | |
| 4,032,077 | 6/1977 | Baselice . | |
| 4,113,195 | 9/1978 | Theunissen . | |
| 4,191,307 | 3/1980 | LeCaire, Jr. et al. | 221/45 |
| 4,274,573 | 6/1981 | Finkelstein | 225/106 |
| 4,289,262 | 9/1981 | Finkelstein | 225/106 |
| 4,297,403 | 10/1981 | Smith | 428/42 |
| 4,314,679 | 2/1982 | Paul et al. . | |
| 4,383,656 | 5/1983 | Campbell . | |
| 4,410,221 | 10/1983 | Vallis et al. . | |
| 4,467,974 | 8/1984 | Crim . | |
| 4,487,378 | 12/1984 | Kobayashi . | |
| 4,513,923 | 4/1985 | Ulics . | |
| 4,535,947 | 8/1985 | Hidle . | |
| 4,583,642 | 4/1986 | Blythe et al. | 206/390 |
| 4,614,312 | 9/1986 | Del Pino . | |
| 4,634,067 | 1/1987 | White . | |
| 4,659,028 | 4/1987 | Wren . | |
| 4,662,576 | 5/1987 | Paul . | |
| 4,667,890 | 5/1987 | Gietman, Jr. . | |
| 4,695,005 | 9/1987 | Gietman, Jr. . | |
| 4,757,952 | 7/1988 | Balzer . | |
| 4,760,970 | 8/1988 | Larsson et al. | 242/160.1 |
| 4,767,075 | 8/1988 | Peters et al. . | |
| 4,783,015 | 11/1988 | Shimizu . | |
| 4,807,825 | 2/1989 | Elsner et al. . | |
| 4,832,271 | 5/1989 | Geleziunas . | |
| 4,860,893 | 8/1989 | Kaufman | 200/390 |
| 5,065,924 | 11/1991 | Granger | 225/46 |
| 5,097,998 | 3/1992 | Shimasaki | 225/106 |
| 5,100,075 | 3/1992 | Morand . | |
| 5,161,793 | 11/1992 | Lotto et al. | 271/182 |
| 5,170,938 | 12/1992 | Dewing | 239/52 |
| 5,170,958 | 12/1992 | Brown . | |
| 5,197,727 | 3/1993 | Lotto et al. | 271/183 |
| 5,205,455 | 4/1993 | Moody | 225/106 |
| 5,215,211 | 6/1993 | Eberle | 221/1 |
| 5,219,126 | 6/1993 | Schutz . | |
| 5,253,818 | 10/1993 | Craddock . | |
| 5,271,137 | 12/1993 | Schutz | 29/400.1 |
| 5,271,575 | 12/1993 | Weinert . | |
| 5,277,375 | 1/1994 | Dearwester . | |
| 5,281,386 | 1/1994 | Weinert | 264/512 |
| 5,310,129 | 5/1994 | Whittington et al. . | |
| 5,314,131 | 5/1994 | McCanless et al. . | |
| 5,352,319 | 10/1994 | Ishizu et al. | 156/446 |
| 5,362,013 | 11/1994 | Gietman, Jr. et al. | 242/521 |
| 5,366,175 | 11/1994 | Schutz | 242/597.6 |
| 5,370,336 | 12/1994 | Whittington | 242/560.2 |
| 5,370,339 | 12/1994 | Moody et al. | 242/597.6 |
| 5,372,865 | 12/1994 | Arakawa et al. | 428/40 |
| 5,385,318 | 1/1995 | Rizzuto | 242/597.8 |
| 5,386,950 | 2/1995 | Abt | 242/532 |
| 5,387,284 | 2/1995 | Moody | 118/220 |
| 5,390,875 | 2/1995 | Gietman, Jr. et al. | 242/521 |
| 5,402,960 | 4/1995 | Oliver et al. | 242/527.1 |
| 5,407,509 | 4/1995 | Ishizu et al. | 156/184 |
| 5,421,536 | 6/1995 | Hertel et al. | 242/526.1 |
| 5,439,187 | 8/1995 | Shimizu | 242/541.7 |
| 5,451,013 | 9/1995 | Schutz | 242/597.4 |
| 5,453,070 | 9/1995 | Moody | 493/288 |
| 5,467,935 | 11/1995 | Moody | 242/422.4 |
| 5,467,936 | 11/1995 | Moody | 242/525.7 |
| 5,474,436 | 12/1995 | Yamazaki | 425/103 |
| 5,480,060 | 1/1996 | Blythe | 221/63 |
| 5,495,997 | 3/1996 | Moody | 242/561 |
| 5,497,959 | 3/1996 | Johnson et al. | 242/542.2 |
| 5,505,402 | 4/1996 | Vigneau | 242/527.1 |
| 5,513,478 | 5/1996 | Abt | 53/118 |
| 5,518,200 | 5/1996 | Kaji et al. | 252/538.1 |
| 5,538,199 | 7/1996 | Biagiotti | 242/541.2 |
| 5,542,622 | 8/1996 | Biagiotti | 242/521 |
| 5,577,686 | 11/1996 | Moody | 242/597.4 |
| 5,603,467 | 2/1997 | Biagiotti | 242/521 |
| 5,609,269 | 3/1997 | Behnke et al. | 221/48 |
| 5,611,455 | 3/1997 | McCreary | 221/45 |
| 5,618,008 | 4/1997 | Dearwester et al. | 242/594.5 |
| 5,620,148 | 4/1997 | Mitchell | 242/160.4 |
| 5,620,544 | 4/1997 | Cram et al. | 156/184 |
| 5,636,812 | 6/1997 | Conner et al. | 242/559.2 |
| 5,639,046 | 6/1997 | Biagiotti | 242/541.2 |
| 5,642,810 | 7/1997 | Warner et al. | 206/389 |
| 5,660,349 | 8/1997 | Miller et al. | 242/526.1 |
| 5,669,576 | 9/1997 | Moody | 242/560.3 |
| 5,690,296 | 11/1997 | Biagiotti | 242/521 |
| 5,697,576 | 12/1997 | Bloch et al. | 242/596.8 |
| 5,722,608 | 3/1998 | Yamazaki | 242/160.1 |
| 5,725,176 | 3/1998 | Vigneau | 242/521 |
| 5,730,387 | 3/1998 | Yamazaki | 242/532.3 |
| 5,746,379 | 5/1998 | Shimizu | 242/160.1 |
| 5,794,882 | 8/1998 | Lewis | 242/423.1 |
| 5,797,559 | 8/1998 | Coffey | 242/527.6 |
| 5,839,680 | 11/1998 | Biagiotti | 242/160.1 |
| 5,848,762 | 12/1998 | Reinheimer et al. | 242/595 |

| | | | |
|---|---|---|---|
| 5,849,357 | 12/1998 | Andersson | 427/179 |
| 5,868,275 | 2/1999 | Moody | 221/33 |
| 5,868,342 | 2/1999 | Moody et al. | 242/560 |
| 5,875,985 | 3/1999 | Cohen et al. | 242/160 |
| 5,895,008 | 4/1999 | Sanders | 242/541.2 |
| 5,904,316 | 5/1999 | Dunning et al. | 242/595 |

FOREIGN PATENT DOCUMENTS

| | | | |
|---|---|---|---|
| 0 589 481 | 3/1994 | European Pat. Off. . | |
| 0 608 046 | 7/1994 | European Pat. Off. . | |
| 0698367A1 | 2/1996 | European Pat. Off. . | |
| 0842881A2 | 5/1998 | European Pat. Off. . | |
| 2 251 202 | 6/1975 | France . | |
| 1248002 | 9/1971 | United Kingdom . | |
| 2 120 206 | 11/1983 | United Kingdom . | |
| 2 244 472 | 12/1992 | United Kingdom . | |
| 2 276 107 | 9/1994 | United Kingdom | 242/160.1 |
| 2 294 681 | 5/1996 | United Kingdom . | |
| 93/10700 | 6/1993 | WIPO . | |
| 93/21094 | 10/1993 | WIPO . | |
| 94/27483 | 12/1994 | WIPO . | |
| 94/29205 | 12/1994 | WIPO . | |
| 95/01929 | 1/1995 | WIPO . | |
| 95/08940 | 4/1995 | WIPO . | |
| 95/13183 | 5/1995 | WIPO . | |
| 96/26878 | 9/1996 | WIPO . | |
| 96/27546 | 9/1996 | WIPO . | |
| 96/28079 | 9/1996 | WIPO . | |
| 99/12462 | 3/1999 | WIPO . | |

INDENTED CORELESS ROLLS AND METHODS OF MAKING AND USING

This application is a continuation application of U.S. patent application Ser. No. 08/402,341, now U.S. Pat. No. 5,620,148 entitled "Methods of Making Indented Coreless Rolls" filed in the U.S. Patent and Trademark Office on Mar. 10, 1995. The entirety of this application is hereby incorporated by reference.

BACKGROUND OF THE INVENTION

1. Field of the Invention

This invention pertains to the field of commercial and consumer absorbent paper products, which includes toilet tissue and paper towels. More specifically, this invention relates to an improved coreless roll of absorbent paper product that is formed so as to be easy to mount onto a dispenser.

2. Description of the Prior Art

Commercial and consumer absorbent paper products such as toilet tissue and paper towels are typically distributed and dispensed in roll form, and nearly always include a hollow cylindrical core that the product is wrapped about. The core is usually some type of cardboard, which is glued together and to the product so that the core stays intact and the product does not separate from the core. The product is then dispensed by mounting the roll on a spindle, such as can be found on the ubiquitous bathroom toilet roll dispenser, that passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of toilet tissue have appeared on the market, primarily in Europe, that are wound throughout the entire diameter of the roll. There are advantages and disadvantages associated with the coreless rolls. Coreless rolls are ecologically superior to cored rolls because no adhesives or throwaway materials are used to make the product. In addition, more product can be provided in the space that would otherwise have been occupied by the core. Cored rolls are more expensive to manufacture than coreless rolls because of the expense of making the cores and joining the cores to the product. In addition, coreless rolls have the advantage of being less subject to pilferage in commercial locations because of their inherent incompatibility with conventional dispensers.

On the other hand, there are dispensing problems with coreless rolls that so far been difficult to overcome. Conventional dispensers for coreless rolls typically include an enclosed support surface that the roll is supported on as it turns, and an opening through which the product is passed. While functional, these dispensers have some undesirable characteristics, including an inability to control drag resistance to withdrawal of the product, the fact that the product actually touches the inside of the dispenser, which might be considered unsanitary by some consumers, and an inability to provide 180 degree product access to the consumer.

Many of the above described problems would be overcome if a dispenser existed for mounting a coreless roll to rotate about its axis, as cored roll dispensers do. Unfortunately, such a dispenser has yet to be successfully developed. One of the problems that stands in the way of the development of such a dispenser involves how the coreless roll is to be centered on the dispenser. If the roll is not centered, a rotating imbalance will be created as the roll turns. Also, the roll will be prevented from dispensing product until expiration in the event that its winding axis is not precisely centered on the dispenser. However, since the typical coreless roll has flat, unbroken side surfaces, it is difficult to locate the location of the winding axis.

It is clear that a need exists for an improved system, method and product for permitting the effective dispensing of coreless rolls of absorbent consumer and commercial paper products.

SUMMARY OF THE INVENTION

Accordingly, it is an object of the invention to provide an improved system, method and product for permitting the effective dispensing of coreless rolls of absorbent consumer and commercial paper products.

According to a first aspect of the invention, a method of treating a coreless roll of absorbent paper product so as to make it easier for a user to center a winding axis of the coreless roll with respect to a dispenser includes steps of: (a) positioning a tool adjacent to at least one side of the coreless roll so that the tool is substantially centered with respect to the winding axis of the roll; and (b) pressing the tool into the side of the roll to form a visible depression in the side of the roll that is centered with respect to the winding axis of the roll, whereby maintenance personnel will find it easier to center the roll with respect to a dispenser.

A method of mounting a coreless roll of absorbent paper product into a dispenser according to a second aspect of the invention includes steps of (a) locating at least one depression that is formed in at least one side surface of the coreless roll; (b) aligning the coreless roll with respect to the dispenser with the aid of the depression; and (c) securing the coreless roll onto the dispenser in the aligned position.

According to a third aspect of the invention, a coreless roll of absorbent paper product that is configured to be easier to mount to a rotary dispenser than coreless rolls heretofore known includes a rolled web of absorbent paper product that is rolled about a winding axis into a cylinder having first and second flat ends; and a depression defined in at least one of said ends for guiding a user to center said rolled web with respect to a dispenser, whereby the coreless roll can be conveniently and accurately mounted into the dispenser.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
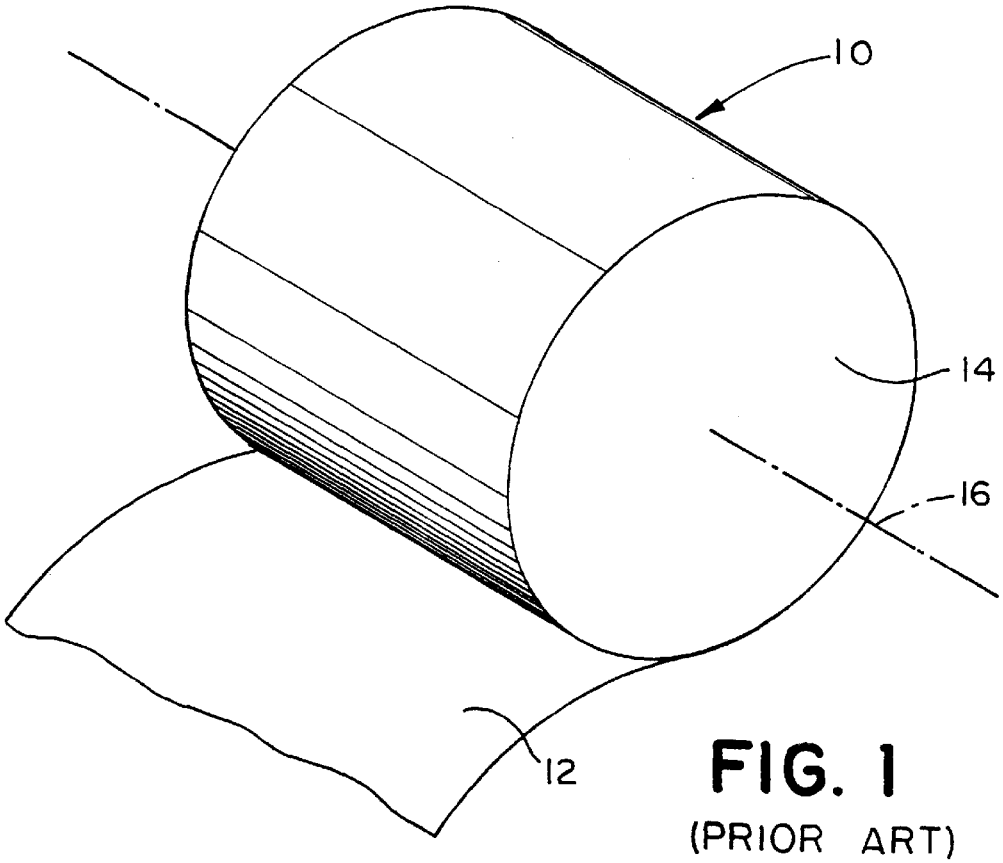
FIG. 1 (PRIOR ART)
FIG. 1 is a perspective view of a conventional coreless roll of an absorbent paper product.

Referring now to the drawings, wherein like reference numeral designate corresponding structure throughout the views, FIG. 1 depicts a conventional coreless role 10 of an absorbent paper product web 12. Coreless role 10 is symmetrical about a winding axis 16 and has a pair of oppositely facing flat side surfaces 14 defined thereon which are substantially flat and unbroken, as is shown in FIG. 1. As may be imagined from viewing FIG. 1, it is difficult to locate the winding axis 16, which accounts for the difficulty of mounting such coreless rolls 10 onto rotary type dispensers such as, for example, the dispenser that is depicted in FIG. 3.

Figure 2A:
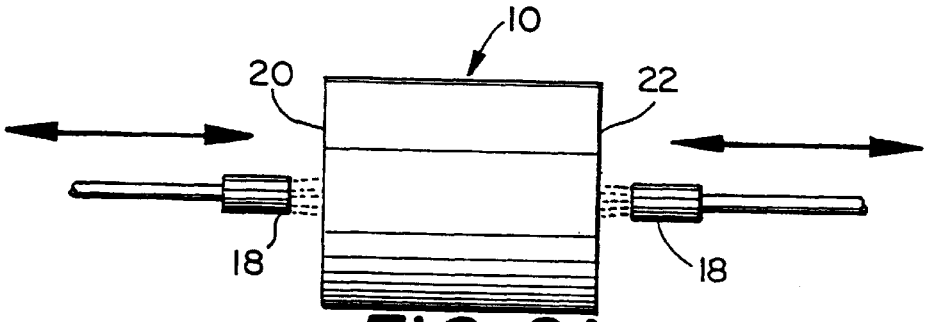
FIG. 2A is a diagrammatical view depicting a first step in a process that is performed according to a preferred embodiment of the invention.
Figure 2B:
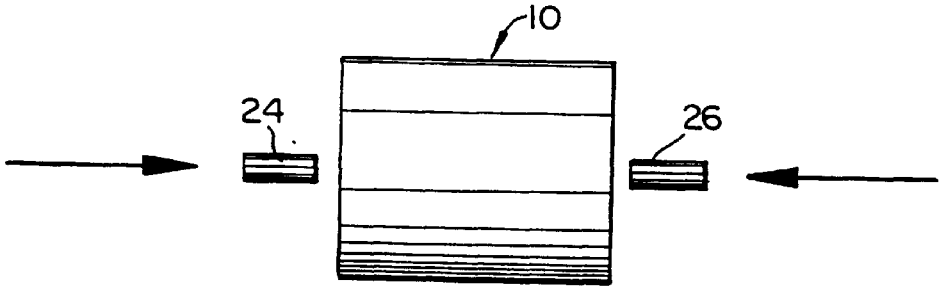
FIG. 2B is a diagrammatical view depicting a second step in the process shown in FIG. 2A.
Figure 2C:
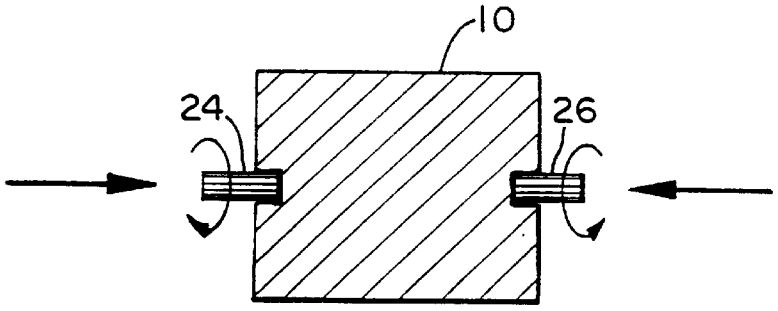
FIG. 2C is a diagrammatical view depicting a third step in the process shown in FIGS. 2A and 2B.
Figure 2D:
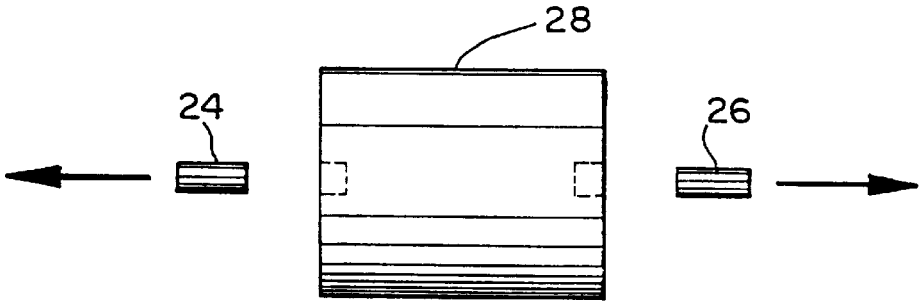
FIG. 2D is a diagrammatical view depicting a fourth step in the process shown in FIGS. 2A–2C.
Figure 3:
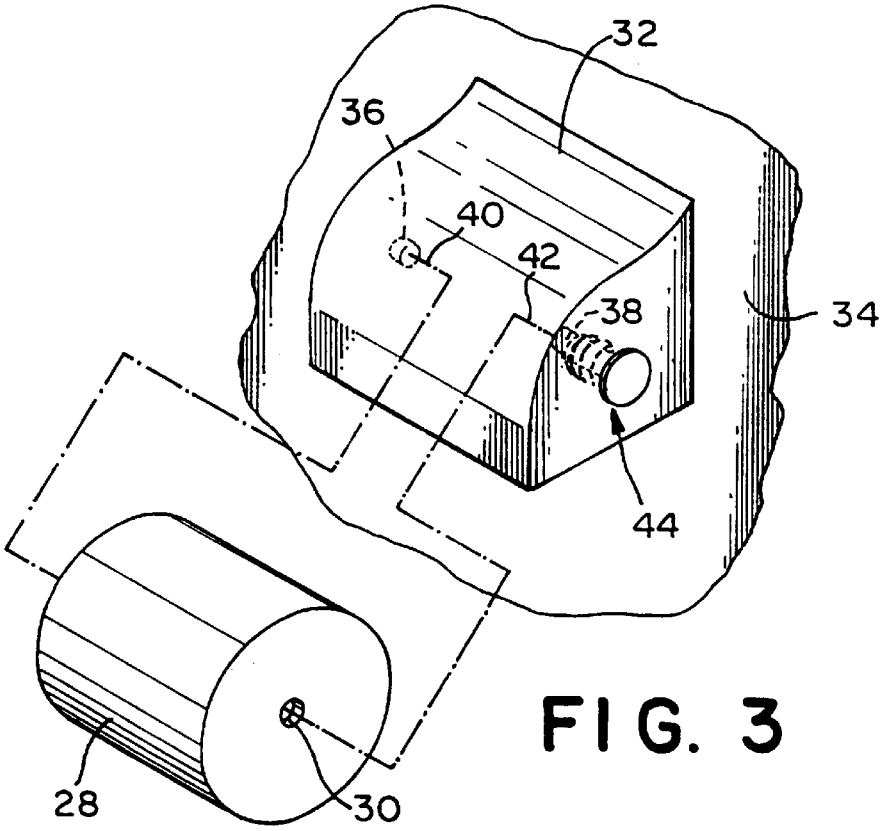
FIG. 3 is an assembly viewed depicting installation of an improved coreless role according to a preferred embodiment of the invention on to a dispenser.

FIGS. 2A–2D depict a method, according to a preferred embodiment of the invention, of treating such a coreless roll 10 of absorbent paper product 12 so as to make it easier for a user to center a winding axis 16 of the coreless roll 10 with respect to a dispenser, such as the dispenser 32 that is depicted in FIG. 3. Referring to FIGS. 2A–2D, the preferred method is performed by first dampening selected portions of the two oppositely facing side surfaces 20, 22 of the coreless roll 10. In a preferred embodiment, this is carried out by advancing a pair of nozzles 18, respectively, toward the side surfaces 22 to dampen the central area of the side surfaces 20, 22. Nozzles 18 are then retracted, as is also indicated diagrammatically in FIG. 2A.

Alternatively, the dampening depicted in FIG. 2A could be performed in other ways, such as by using the indenting tool itself to perform the dampening. The indenting tool could have a fluid passage defined therein, or a reservoir for holding the dampening fluid.

As is shown in FIG. 2B, a pair of cylindrical tools 24, 26 are then advanced toward the wetted center portion of the side surfaces 20, 22 of the coreless roll 10. Tools 24, 26 preferably have a diameter that is within the range of substantially 1/32 of an inch to one half of an inch. Most preferably, tools 24, 26 have diameters that are approximately 5/32 of an inch. Tools 24, 26 are preferably turned about their respective axis as they are advanced into the wetted sides 20, and 22 of the coreless roll 10, as is shown in FIG. 2C. The inventors have found that by wetting the area to be indented considerably less force is required to form the indentation. At the same time, the wetting enables a more uniform and molded appearance to be achieved when forming the depression. In addition, the inventors have determined that the most effective method of making the indentation seems to be a combination of a rotary and plunging action. A piston-like plunging action, without the rotary motion, and especially without dampening, has been found to damage the edges of the hole or depression and lessons the likelihood of being able to obtain a uniform molded appearance.

After the step depicted in FIG. 2C, the tools 24, 26 are withdrawn, leaving the completed improved coreless roll 28 of the absorbent paper product depicted in FIGS. 2D and 3. As is shown in FIG. 3, coreless roll 28 has a clearly defined depression 30 formed in the respective side surfaces 20, and 22 thereof.

The invention also includes a method of mounting the improved coreless roll 28 of absorbent paper product onto a dispenser, such as the dispenser 32 shown in FIG. 3 that is mounted to a wall 34. This is accomplished by locating the depressions 30 that are formed in the respective side surfaces of the improved coreless roll 28, then aligning the coreless roll 28 with respect to the dispenser 32. In practice, this is done by aligning the depressions 30 with dowels 36, 38 in the dispenser 32. Dowels 36, 38 may have pins 40, 42 extending from ends thereof to further aid in retention of the coreless roll 28 on the dispenser 32 during operation. A retracting mechanism 44 may be provided to retract the second dowel 38 for ease of installation and/or removal of a coreless roll 28 from the dispenser 32.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of treating a coreless roll of absorbent paper product wound throughout the entire diameter of the roll so as to make it easier for a user to center a winding axis of the coreless roll with respect to a dispenser, comprising steps of:

(a) positioning a substantially cylindrical tool having a diameter that is within the range of substantially 1/32" to 1/2" adjacent to at least one side of the coreless roll so that the substantially cylindrical tool is substantially centered with respect to the winding axis of the roll; and (b) pressing the substantially cylindrical tool into the side of the roll to form a visible depression in the side of the roll that is centered with respect to the winding axis of the roll; whereby persons loading the treated roll onto a dispenser will find it easier to center the roll with respect to a dispenser.

2. A method according to claim 1, wherein step (b) is performed by rotating the substantially cylindrical tool about an axis of the tool as the substantially cylindrical tool is pressed into the side of the roll.

3. A method according to claim 1, wherein the cylindrical portion of the tool has a diameter that is approximately 5/32".

4. A method according to claim 1, wherein step (b) is performed so that the substantially cylindrical tool penetrates into the coreless roll a distance within the range of substantially 1/32" to 1/2".

5. A method according to claim 4, wherein step (b) is performed so that the substantially cylindrical tool penetrates into the coreless roll a distance of approximately 3/16".

6. A coreless roll of absorbent paper product that is manufactured according to the method set forth in claim 1.

7. A method of mounting a coreless roll of absorbent paper product into a dispenser, comprising steps of:

(a) locating at least one depression that is formed by a substantially cylindrical tool having a diameter that is within the range of substantially 1/32" to 1/2" in at least one side surface of the coreless roll;

(b) aligning the coreless roll with respect to the dispenser with the aid of the depression; and (c) securing the coreless roll onto the dispenser in the aligned position.

8. A method according to claim 7, wherein step (a) is performed by locating a pair of depressions in the coreless roll, a first of the depressions being formed by a substantially cylindrical tool having a diameter that is within the range of substantially 1/32" to 1/2" on one side of the roll and substantially centered with respect to a 30 winding axis of the roll, the second depression being formed by a substantially cylindrical tool having a diameter that is within the range of substantially 1/32" to 1/2" on a second, opposite side of the roll and also being substantially centered with respect to the winding axis of the roll.

9. A coreless roll of absorbent paper product wound throughout the entire diameter of the roll that is configured to be easier to mount to a rotary dispenser than conventional coreless rolls wound throughout the entire diameter of the roll, comprising:

a rolled web of absorbent paper product that is rolled about a winding axis into a cylinder having first and second flat ends; and a pair of depressions defined in the coreless roll, a first of the depressions being formed by a substantially cylindrical tool having a diameter that is within the range of substantially 1/32" to 1/2" on one side of the roll and substantially centered with respect to a winding axis of the roll, the second depression being formed by a substantially cylindrical tool having a diameter that is within the range of substantially 1/32" to 1/2" on a second opposite side of the roll and also being substantially centered with respect to the winding axis of the roll, the depressions being adapted for guiding a user to center said rolled web with respect to a dispenser, whereby the coreless roll can be conveniently and accurately mounted into the dispenser.

10. A coreless roll according to claim 9, wherein said web is not cut to form said depression.

11. A coreless roll according to claim 9, wherein said depression formed by pressing the substantially cylindrical tool into said end while a portion of the rolled web that the tool penetrates is damp.

* * * * *